US009089461B1

(12) United States Patent
Vosters

(10) Patent No.: US 9,089,461 B1
(45) Date of Patent: Jul. 28, 2015

(54) MOBILITY AND COMFORT AUXILIARY BED APPARATUS

(76) Inventor: Joseph P. Vosters, Appleton, WI (US)

( * ) Notice: Subject to any disclaimer, the term of this patent is extended or adjusted under 35 U.S.C. 154(b) by 452 days.

(21) Appl. No.: 12/646,944

(22) Filed: Dec. 23, 2009

Related U.S. Application Data

(60) Provisional application No. 61/141,221, filed on Dec. 29, 2008.

(51) Int. Cl.
*A61G 7/053* (2006.01)
*A47C 21/00* (2006.01)

(52) U.S. Cl.
CPC ..... *A61G 7/053* (2013.01); *A47C 21/00* (2013.01); *A61G 7/0536* (2013.01)

(58) Field of Classification Search
CPC ..... A47C 21/00; A47C 21/08; A61G 7/053; A61G 7/0533; A61G 7/0536
USPC ..... 5/662, 503.1, 507.1, 658, 905; 602/33; 248/121, 126, 127; 211/4, 13.1
See application file for complete search history.

(56) References Cited

U.S. PATENT DOCUMENTS

| | | | | | |
|---|---|---|---|---|---|
| 1,341,483 | A | | 5/1920 | Slocum | |
| 1,698,754 | A | * | 1/1929 | Gadbois | 5/83.1 |
| 2,259,757 | A | | 10/1941 | Longfellow | |
| 2,817,854 | A | | 12/1957 | Pratt | |
| 3,310,817 | A | * | 3/1967 | Harding | 5/662 |
| 3,889,910 | A | | 6/1975 | Walters | |
| 4,003,479 | A | | 1/1977 | Reyer | |
| 4,236,265 | A | * | 12/1980 | Carradine | 5/630 |
| 4,642,824 | A | * | 2/1987 | Hodges | 5/81.1 R |
| 4,686,727 | A | * | 8/1987 | Wilkinson | 5/503.1 |
| 4,747,171 | A | * | 5/1988 | Einsele et al. | 5/425 |
| 4,932,090 | A | | 6/1990 | Johansson | |
| 5,038,430 | A | * | 8/1991 | Bly | 5/425 |
| 5,207,405 | A | | 5/1993 | Cobb | |
| 5,359,741 | A | * | 11/1994 | Lang | 5/507.1 |
| 5,463,784 | A | * | 11/1995 | Alpern | 5/430 |
| 5,509,152 | A | * | 4/1996 | Kippes | 5/81.1 R |
| 6,581,897 | B2 | | 6/2003 | Ruschke | |
| 6,934,980 | B2 | | 8/2005 | Harney | |
| 7,036,160 | B1 | * | 5/2006 | Pecoraro | 5/2.1 |
| 7,103,928 | B1 | * | 9/2006 | Childs | 5/426 |
| 2003/0163871 | A1 | * | 9/2003 | Conlu et al. | 5/503.1 |
| 2003/0192117 | A1 | * | 10/2003 | Allen et al. | 5/81.1 R |
| 2006/0162083 | A1 | | 7/2006 | Heimbrock | |
| 2007/0089242 | A1 | * | 4/2007 | Battiston | 5/662 |

* cited by examiner

*Primary Examiner* — Nicholas Polito
*Assistant Examiner* — Eric Kurilla
(74) *Attorney, Agent, or Firm* — Brannen Law Office, LLC

(57) ABSTRACT

The present inventions relate to a mobility and comfort auxiliary bed apparatus, and in particular to a modular and free-standing apparatus that is customizable with many components. In one embodiment, two spaced apart and parallel frame bars are provided, each with opposed vertical risers and a longitudinal rail that is positionable over a bed. An overhead grip such as a trapeze bar may be movably supported by the frame bars. A balance pole may be provided and be adjustably connected to both frame bars laterally and longitudinally. Assist rails and night stands may be further provided, and may be supported by one or more centrally located longitudinal supports underneath the bed. The present invention can be fixed to the bed and may be adjusted in width, length and mattress height to accommodate many components.

5 Claims, 9 Drawing Sheets

MOBILITY AND COMFORT AUXILIARY BED APPARATUS

This utility patent application claims priority on and the benefit of provisional application 61/141,221 filed Dec. 29, 2008, the entire contents of which are hereby incorporated herein by reference.

BACKGROUND OF THE INVENTION

1. Field of the Invention

The present inventions relate to a mobility and comfort auxiliary bed apparatus, and in particular to a modular and free-standing apparatus that is customizable with many components.

2. Description of the Related Art

Mobility, comfort and the ability to maneuver and participate in or control one's surroundings are central themes to the quality of life for people with injuries, sickness, old age and other health issues. To this end, there are many available products that have been designed over the years.

One example is shown in U.S. Pat. No. 2,817,854 to Pratt titled Guard Attachment for Beds. This patent describes a guard gate that is detachably applied to the side rail of a bed frame. The guard gate can be positioned either in an upwardly extending operative position or a downwardly extending out of use position. While this invention may work well for its intended purpose, the use of a bed frame with a side rail is necessary.

Another example is shown in U.S. Pat. No. 6,581,897 to Ruschke titled Fracture Frame Mounting Apparatus, Bracket, and Method. This patent illustrates an example of a fracture frame that is mounted directly to a patient-support apparatus. This invention, being designed for use with a patient support apparatus, may be limited in its use.

A further example is shown in U.S. Pat. No. 4,932,090 to Johanson titled Movable Support Bar. This patent teaches that a support tube can be mounted to the floor, and that a support arm may be pivotally retained by the support tube. A trigger release can be provided and the height is taught to be adjustable. One drawback of mounting a support arm to the floor is that the mounting can permanently damage or alter the floor. The patent also describes using a flange to mount the support bar to an existing bed frame.

A still further example is shown in U.S. Pat. No. 2,259,757 to Longfellow titled Surgical Frame for Hospital Beds. Yet again, this patent is an example of a frame that is mounted directly to a bed. It can be undesirable to design a frame for use with a particular bed frame because all hospital bed frames are not universally dimensioned. A single bar is shown to span between the head and foot portion of the bed. An arm is shown to be connected to the bar and vertically supported by an additional arm 60. Rotation of the arm around the bar appears to be limited by having a square bar.

A still further example yet is provided in U.S. Pat. No. 6,934,980 to Harney titled Patient Transfer System. An overhead canopy is provided. The canopy is a free standing canopy.

A still further example yet is illustrated in U.S. Pat. No. 1,341,483 to Slocum titled Comfort Frame. This patent shows a frame having spaced parallel bars 1 upstanding at their base and interconnected by a transverse members 3 and 4. Two longitudinal members 5 are connected to the transverse members.

A still further example yet is U.S. Pat. No. 3,889,910 to Walters titled floor Stand Support and Bracing System. This patent shows a U-shaped base member having first and second leg members 3 and 4. As seen in FIGS. 5-7, several components can be secured to the elongate arm 1, and that the legs 3 and 4 are adaptable to varying bed configurations.

A still further example yet is U.S. Pat. No. 4,003,479 to Reyer titled Hoist and Transporting Apparatus. This patent illustrates a hoist and transport apparatus that is extendible to a variety of configurations.

A still further example yet is U.S. Pat. No. 5,207,405 to Cobb titled Television stand. This patent shows a television stand that has a base extendible under a bed, and that has an adjustable height.

A still further example yet is United States Published Patent Application Number 2006/0162083 to Heimbrock titled Bed Trapeze Lift with Bed Controls, Lights and Patient Transferability.

While each of these inventions may work well for their intended purposes, there are some remaining needs that heretofore have not been satisfactorily met.

For example, the structural stability of a free-standing structure may be increased without making any alterations to an existing room and without the need to obtain a new specialized bed.

Also, modularity and customization may be improved upon, while maintaining structural rigidity. For example, an apparatus having supports above and below the bed for custom components could be provided.

Further, it would be advantageous to have a system that is fixable to a variety of bed sizes and types, including king, queen, full, twin, home, hospital and long term beds. Related, it would be advantageous to provide increasing levels of stability as the width of the beds (and hence increase of distance from the support that the components are located) increase.

Still further, it would be advantageous to have a system that laterally and longitudinally adjustably supports under-bed and over-bed components.

Still further, it would be advantageous to have a balance pole that is highly resistant to twisting about the overhead supports while under load.

Thus there exists a need for a mobility and comfort auxiliary bed apparatus that solves these and other problems.

SUMMARY OF THE INVENTION

The present inventions relate to a mobility and comfort auxiliary bed apparatus, and in particular to a modular and free-standing apparatus that is customizable with many components. In one embodiment, two spaced apart and parallel frame bars are provided, each with opposed vertical risers and a longitudinal rail that is positionable over a bed. A light box, a head brace and a foot brace can be provided for stability. An overhead grip such as a trapeze bar may be movably supported by the frame bars. A balance pole may be provided and be adjustably connected to both frame bars laterally and longitudinally. Assist rails and one or more night stands may be further provided, and may be supported by longitudinal supports that extend from a head base underneath a bed. The present invention is a free standing structure that can be fixed to the bed, and may be adjusted in length and width and accommodate many components.

According to one advantage of the present inventions, the system is a free standing system (i.e. acts independent of the bed or mattress) and can be used with the patient's existing bed. In this regard, no special bed is required. Further, no alterations or mounting holes are created to support the system.

Related, and also advantageous, the system can be tied or fixed to the bed to provide additional support to the structure. This is accomplished in one embodiment by positioning the bed posts on lateral extensions. This is accomplished in another embodiment by positioning a tab between the side rails and the mattresses and/or box springs. This is accomplished in a third embodiment by fixing or strapping the system feet to the bed posts and/or wheels.

According to a further advantage of an embodiment of the present invention, two frame bars are provided. This results in increases structural stability. For example, accessory components may attach to one or both frame bars. Attaching to both frame bars provides torsional support, as twisting of the components are minimized. This is evident in the design of the balance pole. The pole can be locked into place after being adjusted side-to-side and longitudinally through the double cuffs. After the adjustments have been made and the balance pole locked into place, it is very stable to the user and can also increase the structural strength of the system.

According to a still further advantage of the present invention, the assist rails and night stands may also be adjustable laterally to the side of the bed, and also longitudinally along the length of the bed. The safety and usability of the present system can therefore be enhanced regardless of the host bed.

According to a still further advantage of the present invention, mobility, comfort, maneuverability and ability for one to participate in their environment can be increased with the present invention.

According to a still further advantage yet of the present invention, supports for custom components are provided both above and below the bed without altering the bed or room.

According to a still further advantage yet of the present invention, the components are adjustable to accommodate beds of differing size, as well as hospital beds.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
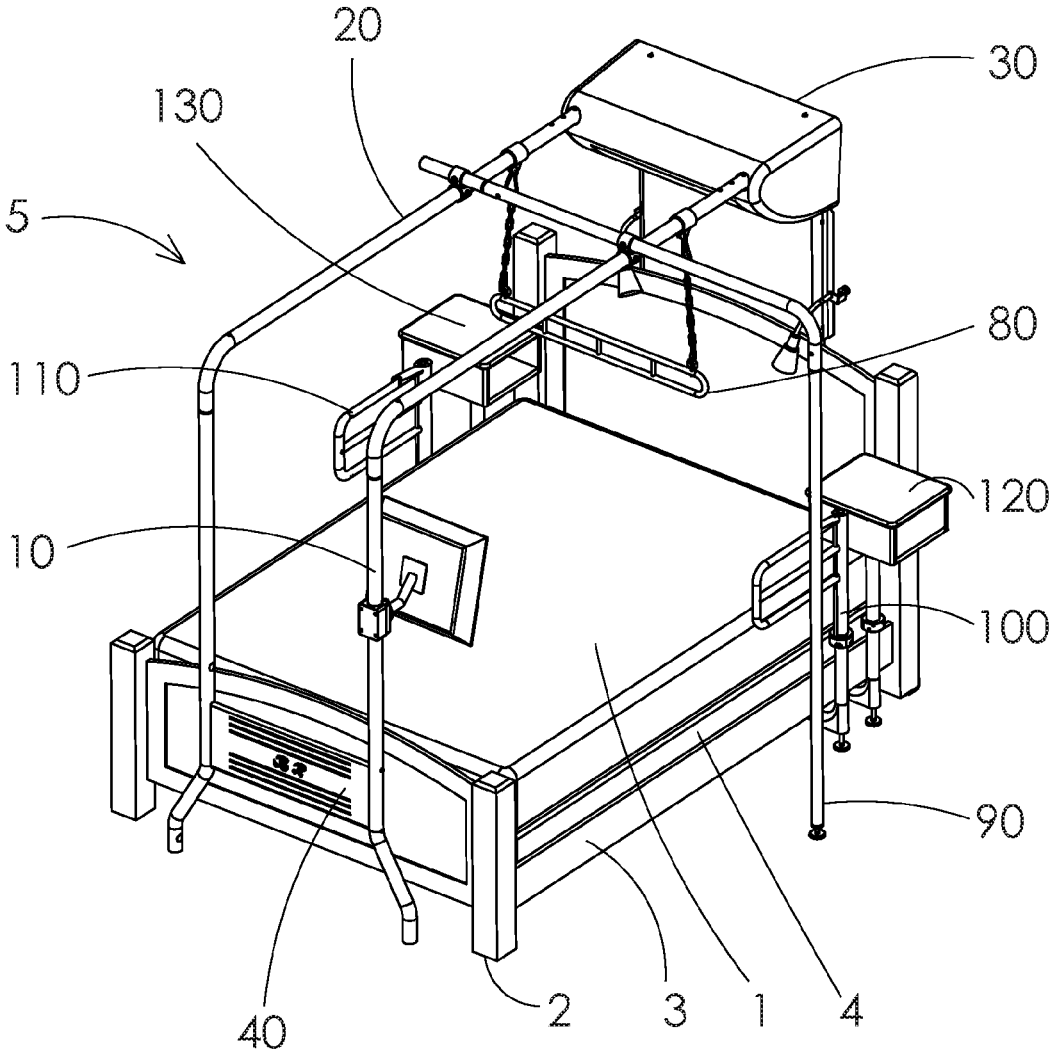
FIG. 1 is a perspective view of a preferred embodiment of the present invention shown in place with a bed.
Figure 2:
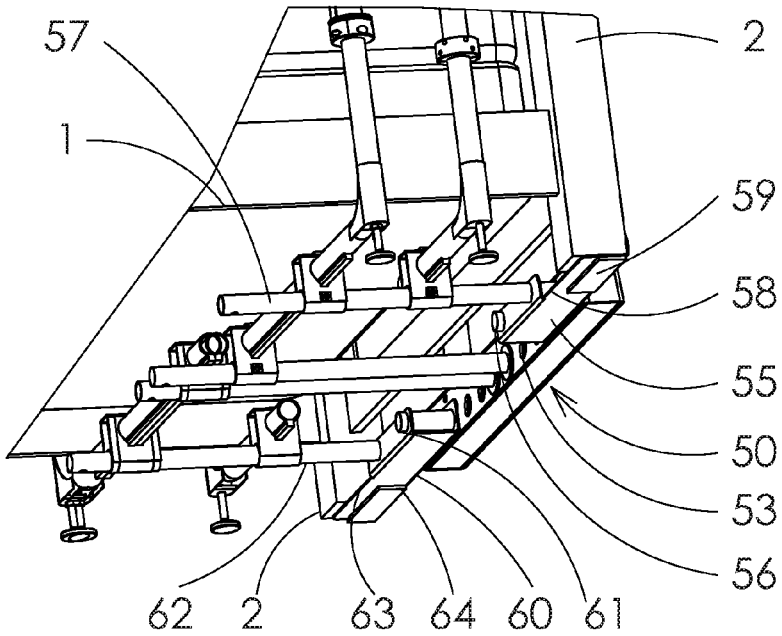
FIG. 2 is a close up underneath perspective view of the preferred embodiment shown in FIG. 1.
Figure 3:
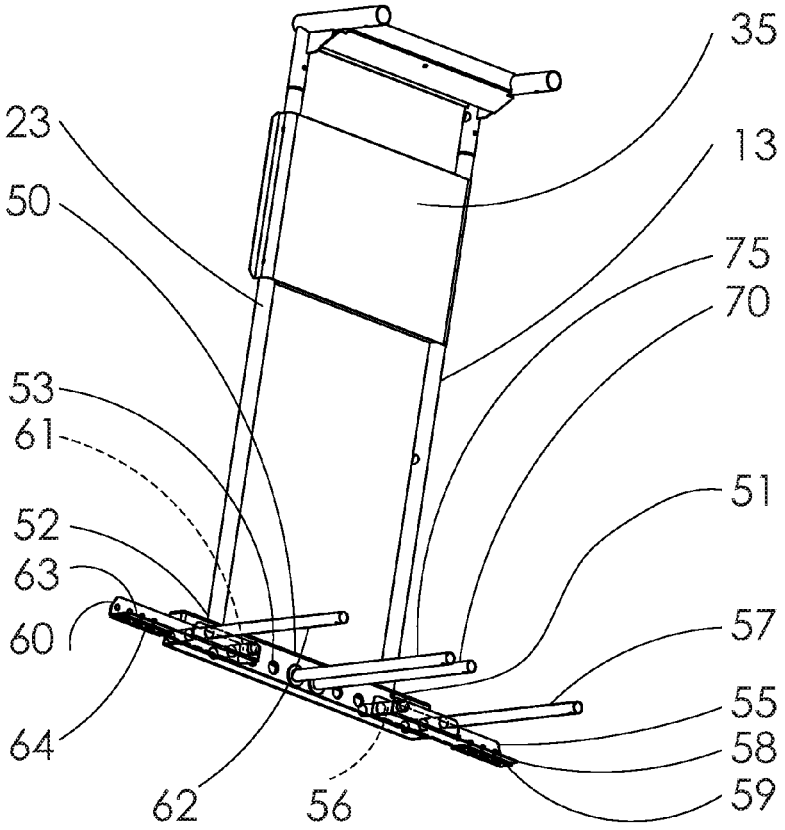
FIG. 3 is an isolation perspective view showing a preferred embodiment of the underbed structure of the present invention.
Figure 4:
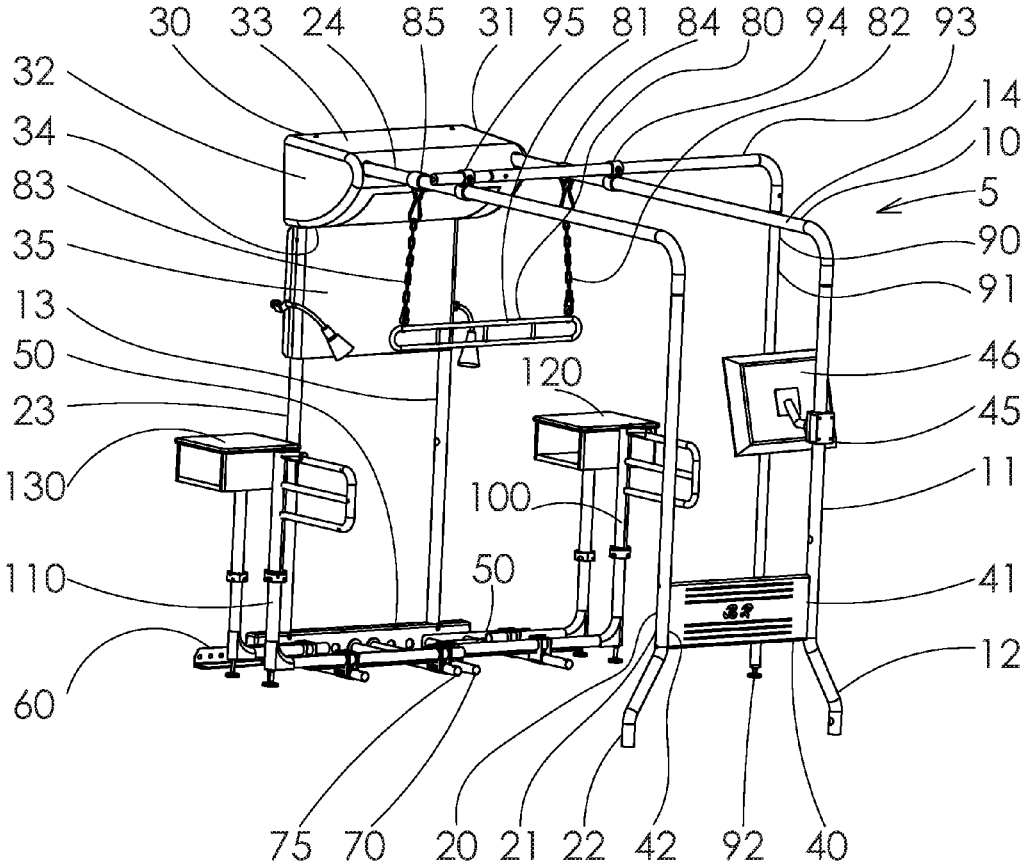
FIG. 4 is a perspective view of the preferred embodiment illustrated in FIG. 1 without a bed.
Figure 5:
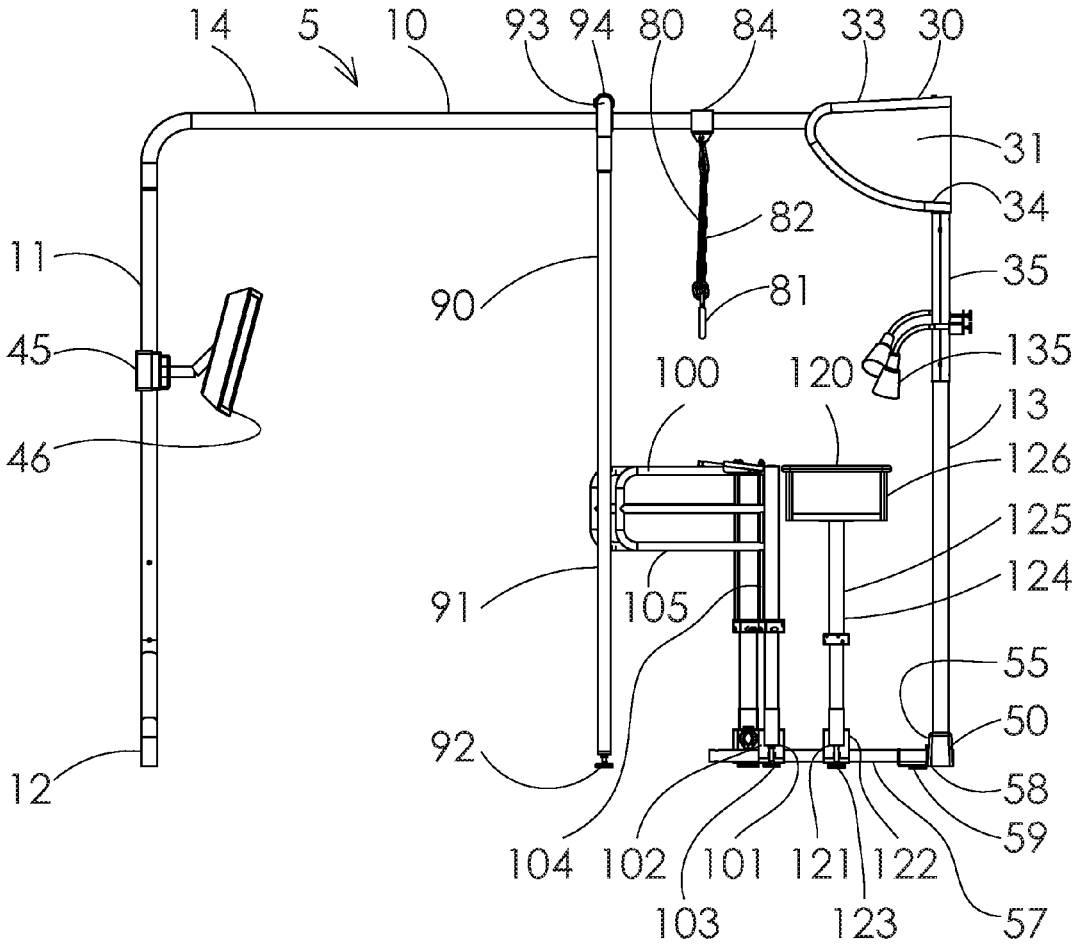
FIG. 5 is a side view of the preferred embodiment illustrated in FIG. 4.
Figure 6:
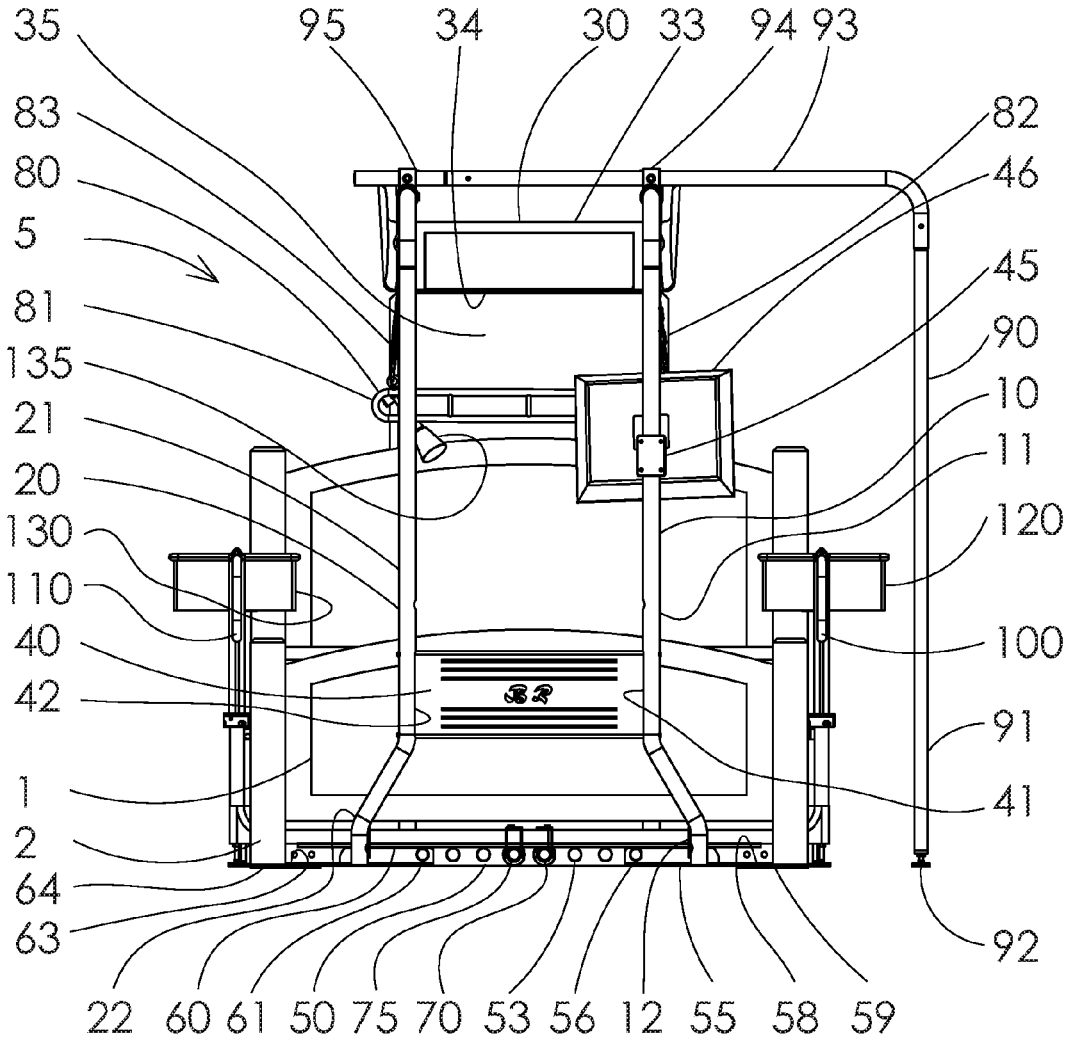
FIG. 6 is an end view of the preferred embodiment illustrated in FIG. 1.
Figure 7:
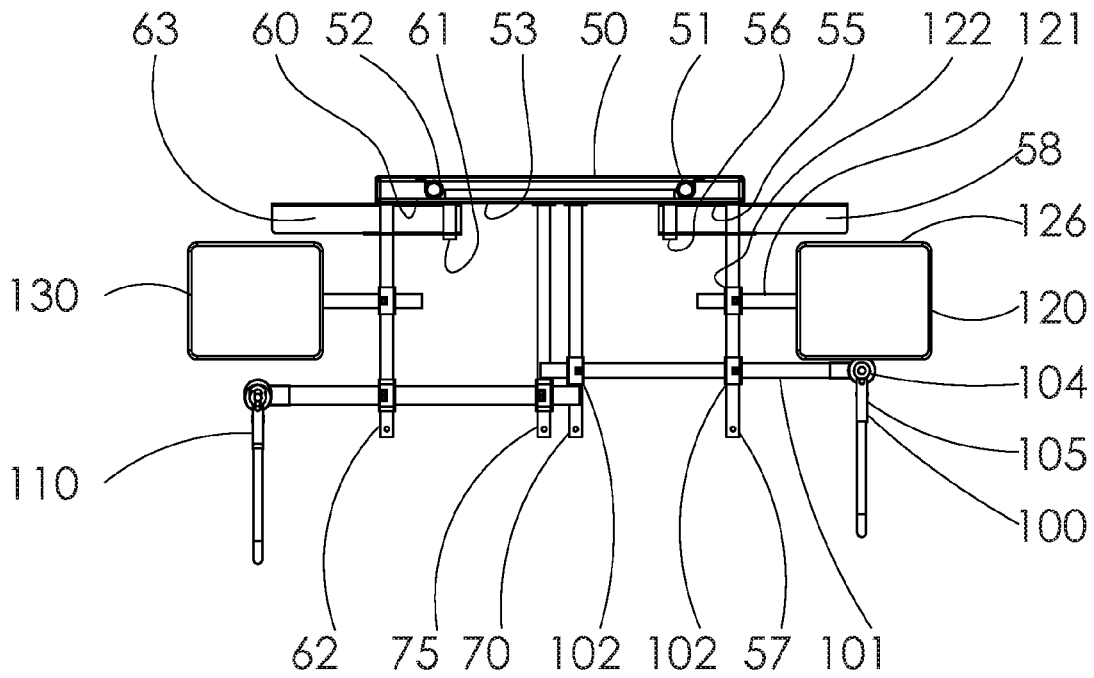
FIG. 7 is a top isolation view showing the preferred embodiment of the underbed structure.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

As seen in FIGS. 1-7, the present invention relates to a system 5 having many components that can be characterized as structural or functional, or both. A bed 1 typically has four legs 2, at each corner of the bed. Rails 3 are typically provided around the perimeter of the bed 1 and support mattresses 4 and or box springs. The rails 3 can be made of wood, steel, high strength plastic or any other suitable material. It is appreciated that other bed styles, such as commonly known as a Hollywood frame with a series of underbed supports and/or wheels and may not have a traditional footboard or feet (which are not required for use with the present invention) may be used without departing from the broad aspects of the present invention.

The structural components can include frame bars 10 and 20, a light box 30, a head brace 35, a foot brace 40, a base 50 at the head and lateral braces 55 and 60. Some of the functional components can include an overhead grip 80, a balance pole 90, assist rails 100 and/or 110, one or more night stands 120 and 130, snake lights 135, and a TV mount 45 with TV 46. Each of these components is described in detail below. Other components which are not specifically illustrated, such as a triangle grip, an overbed table, hand straps or other components, may also be incorporated without departing from the broad aspects of the present invention.

Frame bar 10 is preferably made of a strong and rigid material, such as steel or another metal. Yet, it may also be made of other materials, such as high-strength plastic, without departing from the broad aspects of the present invention. Frame bar 10 is preferably tubular in shape. However, other shapes may be utilized without departing from the broad aspects of the present invention. A first riser 11 and a second riser 13 are provided. The risers 11 and 13 are preferably generally parallel. The bottom of the first riser 11 is preferably outwardly bent to form a foot 12. A longitudinal bar 14 is provided between the risers 11 and 13. The longitudinal bar has a length that is sufficient so that the frame bar 10 may extend beyond the head and foot ends of the bed. The frame bar 10 can be a rigid component of a fixed length or can be variable (extendable and retractable). When variable, it is preferred that the longitudinal bar 14 is telescopic.

Frame bar 20 is preferably made of a strong and rigid material, such as steel or another metal. Yet, it may also be made of other materials, such as high-strength plastic, without departing from the broad aspects of the present invention. Frame bar 20 is preferably tubular in shape. However, other shapes may be utilized without departing from the broad aspects of the present invention. A first riser 21 and a second riser 23 are provided. The risers 21 and 23 are preferably generally parallel. The bottom of the first riser 21 is preferably outwardly bent to form a foot 22. A longitudinal bar 24 is provided between the risers 21 and 23. The longitudinal bar has a length that is sufficient so that the frame bar 20 may extend beyond the head and foot ends of the bed. The frame bar 20 can be a rigid component of a fixed length or can be variable (extendable and retractable). When variable, it is preferred that the longitudinal bar 24 is telescopic.

As seen in FIG. 1, it is seen that feet 12 and 22 have an outwardly divergent bend adjacent the bottom of the risers 11 and 21, respectively.

Frame bars 10 and 20 are preferably in a spaced apart and parallel relationship. In one embodiment, the frame bars are approximately 28 inches apart. Yet, the bar separation could be increased or decreased without departing from the broad aspects of the present invention. Spacing of the frame bars 10 and 20 is maintained by the light box 30, head brace 35, foot brace 40 and head base 50.

The light box 30 has sides 31 and 32, a top 33 and a bottom 34. The top 33 can be coplanar with a plane defined by the longitudinal bars 14 and 24 of the frame bars 10 and 20. The bottom 33 can be angled so that a light recessed within the box 30 shines onto a bed. The light box may be constructed of steel, another metal or plastic, or from another material altogether. The light box 30 can conceal a junction between vertical risers and longitudinal bars of the frame bars 10 and 20, respectively. Also, when the longitudinal bars 14 and 24 are telescopic, the connection can be at least partially concealed within the light box.

A head brace 35 is preferably located below the light box. The head brace 35 is preferably connected to both risers 13 and 23 so as to provide structural support thereto. It is preferably that the head brace 35 be generally planar so as not to project inward or outward from the frame bars. The head brace may be constructed of steel, another metal or plastic, or from another material altogether.

The foot brace 40 has sides 41 and 42 and is preferably connected to the risers 11 and 21 above the feet 12 and 22, respectively. The foot brace is preferably generally planar so as not to project inward or outward from the frame bars. The foot brace may be constructed of steel, another metal or plastic, or from another material altogether.

A base 50 is at the head of the system 5. The base can be constructed of a molded plastic material, wood, metal or from other materials. Base 50 has two vertical holes 51 and 52. Ends of risers 13 and 23 are received within the holes 51 and 52, respectively. There are several key holes 53 formed into the inward side of the base 50. In the preferred embodiment, there are twelve key holes along this surface. Each keyhole is preferably equally spaced and preferably has a parallel longitudinal axis.

An angle brace 55, or lateral brace, is provided. Lateral brace 55 has a peg 56 and a rod 57. The peg 56 and rod 57 project from a first side of the lateral brace 55 and are removably received within the base 50. Rod 57 further projects out from the second side of the lateral brace 55 a selected amount along a longitudinal axis. The brace 55 further has a seat 58 formed by a right angled structure and a pad 59 under the seat 58. The seat 58 is adapted to receive the bottom of a corner post of a bed, whereby the weight of the bed rests on the seat 58 to lock the bed 1 and the system 5 together. It is appreciated that the brace 55 is laterally adjustable relative the base 50. This is accomplished by removing and re-securing the peg 56 and rod 57 in selected keyholes 53 as required by the width of the bed.

An angle brace 60, or lateral brace, is provided. Lateral brace 60 has a peg 61 and a rod 62. The peg 61 and rod 62 project from a first side of the lateral brace 60 and are removably received within the base 50. Rod 62 further projects out from the second side of the lateral brace 60 a selected amount along a longitudinal axis. The brace 60 further has a seat 63 formed by a right angled structure and a pad 64 under the seat 63. The seat 63 is adapted to receive the bottom of a corner post of a bed, whereby the weight of the bed rests on the seat 63 to lock the bed 1 and the system 5 together. It is appreciated that the brace 60 is laterally adjustable relative the base 50. This is accomplished by removing and re-securing the peg 61 and rod 62 in selected keyholes 53 as required by the width of the bed.

Rods 57 and 62 are preferably parallel to each other and extend from the base equal distances. Further, both rods 57 and 62 are preferably equidistant from the center of the bed.

Longitudinal supports 70 and 75 are also preferably provided. The longitudinal supports 70 and 75 are centrally located one the base 50 and are preferably parallel to each other. It is appreciated that because two supports are provided, that each is slightly off center. However, within the scope of this disclosure, both are considered to be central supports. It is further appreciated that one support could be exactly centrally aligned without departing from the broad aspects of the present invention even though it need not be on absolute center to be considered central.

The longitudinal supports 70 and 75 and the rods 57 and 62 provide support to one or more customized accessory components, or underbed components, as described below. It is appreciated that while several underbed components are illustrated, that these examples are illustrative only and are in no way exhaustive. It will also be appreciated that the double longitudinal support structure allows for underbed components to be located at equal locations on opposite sides of the bed.

It is appreciated that the wider braces 55 and 60 are apart, the more resistant the system is to lateral tipping. In this regard, the increase in stability is useful as the stresses due to use of the underbed components also increases as those components are moved farther from the center of the bed.

As can be appreciated, supports are provided for mounting components both above and below the bed, providing for a limitless amount of customization to enhance mobility, comfort, safety and maneuverability of the person.

Turning now to some of the accessories, it is noted that the components can be designated as overbed components or underbed components. It is appreciated that the overbed components are mounted over the bed, and the underbed components are mounted under the bed and project out therefrom.

One component is an overhead grip 80 is provided. One preferred grip 80 is a trapeze bar 81. Others could be a triangle or a hand strap. Trapeze bar 81 has a first hanger 82 and a second hanger 83. A first cuff 84 and a second cuff 85 are provided. The hangers 82 and 83 have adjustable lengths so that the trapeze bar 81 may be desirably vertically oriented. The cuffs 84 and 85 are connected to and permitted to move along the longitudinal bars 14 and 24 of the frame bars 10 and 20. The trapeze bar may be made of steel, another metal, plastic or any other suitable material. It is appreciated that by being supported by two longitudinal bars, sway and twisting of the bar is kept at a minimum and allows safe lifting across the width of the bed.

The balance pole 90 has a vertical bar 91 with a base 92. The base is adjustable along an axis that is generally parallel to the vertical axis of the vertical bar 91. A horizontal bar 93 is also provided. A first double cuff 94 and a second double cuff 95 are provided. Double cuff 94 has two cuffs that are preferably fixed in perpendicular orientations. One cuff may adjustably receive the horizontal bar 93 of the pole 90. The second cuff adjustably moves relative lateral bar 14 of frame bar 10. Double cuff 95 has one cuff that adjustably receives the horizontal bar 93 of pole 90, and a second cuff adjustably movable relative longitudinal bar 24 of frame bar 20. The two double cuffs allow adjustment along the longitudinal axis of the longitudinal bars 14 and 24 of the frame bars 10 and 20, and also lateral adjustment towards or away from the frame bars 10 and 20 to accommodate differing bed sizes and user preference. Twisting of the balance pole 90 is minimized by being connected to and supported by two frame bars 10 and 20. It is noteworthy that the structural rigidity is achieved without altering a building or being fixed directly to a bed. The balance pole may be made of tubular steel or another metal, or by plastic or another suitable material.

Assist rail 100 has a horizontal portion 101 with brackets 102 that attach the horizontal portion 101 to the longitudinal support 70 and rod 57. A base 103 is also provided to minimize the stress on the brackets. In the preferred embodiment, the brace 103 is linearly aligned with the vertical axis of a vertical portion 104 of the assist rail 100. The vertical portion 104 with a swiveling rail 105 is further provided. The swiveling rail 105 has a use position wherein it may be positioned so that it is up against a bed and optional positions wherein the rail is swiveled away from the bed. Adjusting the horizontal portion 101 relative longitudinal support 70 and rod 57 determines how close the swiveling portion 105 is to the bed, as well as the lateral location of the rail 100 relative the bed. The assist rail 100 may be fabricated from steel, another metal, plastic or other suitable material.

Assist rail 110 has a horizontal portion with brackets that attach the horizontal portion to the longitudinal support 75 and rod 62. A base is also provided to minimize the stress on the brackets. In the preferred embodiment, the brace is linearly aligned with the vertical axis of a vertical portion of the assist rail 110. The vertical portion with a swiveling rail is further provided. The swiveling rail has a use position wherein it may be positioned so that it is up against a bed and optional positions wherein the rail is swiveled away from the bed. Adjusting the horizontal portion relative longitudinal support 75 and rod 62 determines how close the swiveling portion is to the bed, as well as the lateral location of the rail 110 relative the bed. The assist rail 110 may be fabricated from steel, another metal, plastic or other suitable material.

Night stand 120 has a horizontal portion 121 that is supported by rod 57, and connected thereto with bracket 122. A base 123 or foot is provided to further support the stand 120 and reduce the stress on the bracket 122. The base 123 is preferably collinear with a shaft of the vertical portion 124. The vertical portion 124 has a swiveling portion 125 and shelf 126 is provided. The night stand may be moved into position adjacent the bed wherein it is accessible to a person, or moved away from the bed. The night stand may be made of steel, another metal plastic or other material. The shelf can be made of plastic, wood or another material.

A second night stand 130 can also be provided. The second night stand 130 is preferably generally the same as night stand 120, and is therefore not described in detail.

It is appreciated that assist rails 100 and 110 can be, but need not be, located at the same longitudinal locations along the length of the bed. The night stands 120 and 130 can also be located at the same longitudinal locations along the length of the bed.

Snake lights 135 may be supported by of the risers 13 or 23 of the frame bars 10 and 20, or both.

A monitor 46, television or other device may be supported by a mount 45 connected to one of the foot risers. An overbed table (not shown) may be provided and may be swivelably connected to one of the assist rails.

It is appreciated that many other components, such IV hangers, mirrors, picture frames and other components may be supported by the system 5. In this regard, the components described above are not intended to be limiting of the present inventions.

It is also appreciated that a monorail may be incorporated into the system 5 to provide a hoisting means to move a person into and out of the bed.

It is still further appreciated that special head and foot boards may be developed to receive the frame bars. In such an embodiment, the new head board and foot board would accept the structural components of the present invention.

While the present invention is illustrated in connection with a double or queen bed size, it is appreciated that the present invention can also be designed for use with single, twin, king and hospital bed sizes.

Figure 8:
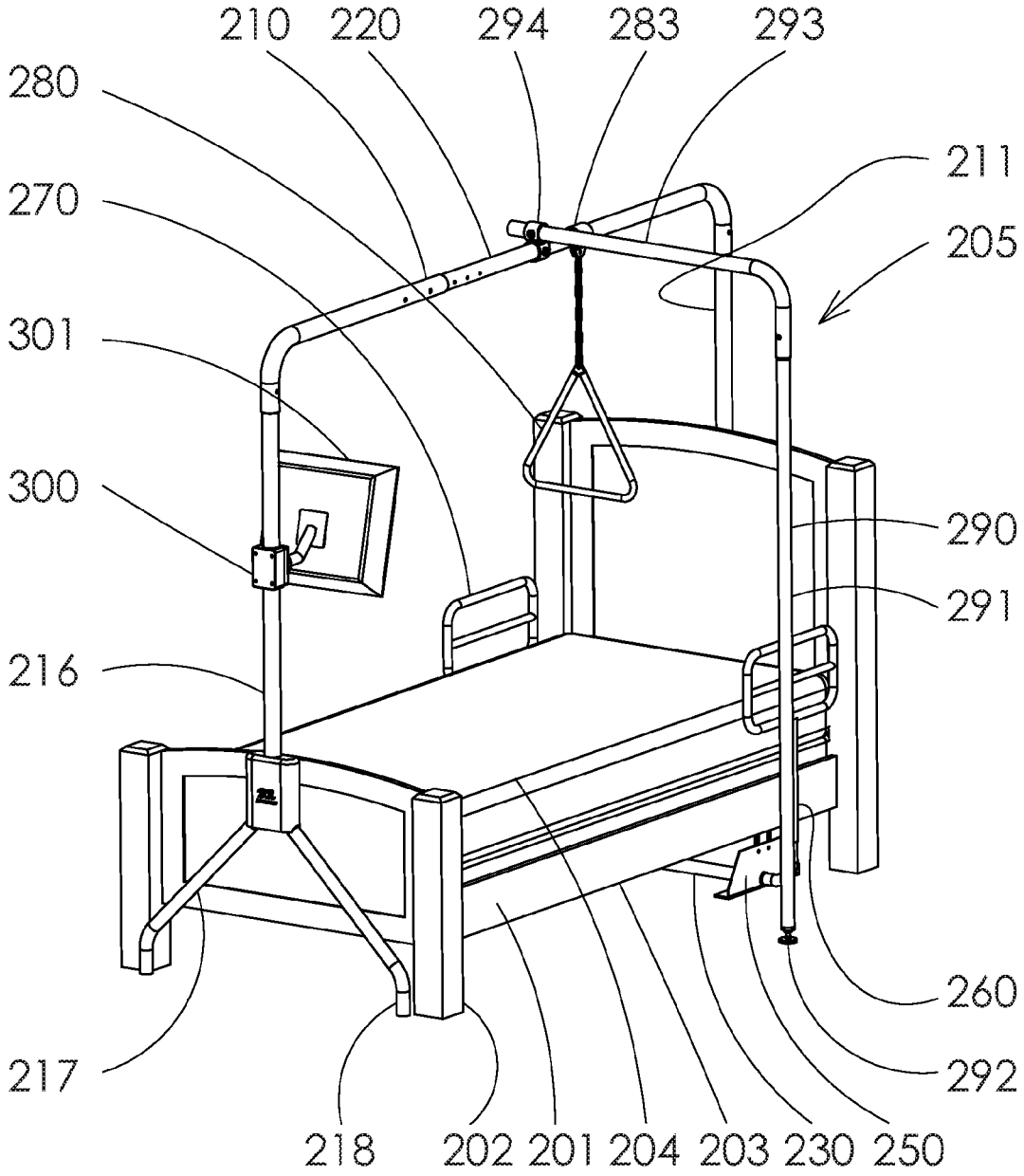
FIG. 8 is a perspective view of an alternative embodiment of the present invention shown in place with a bed.
Figure 9:
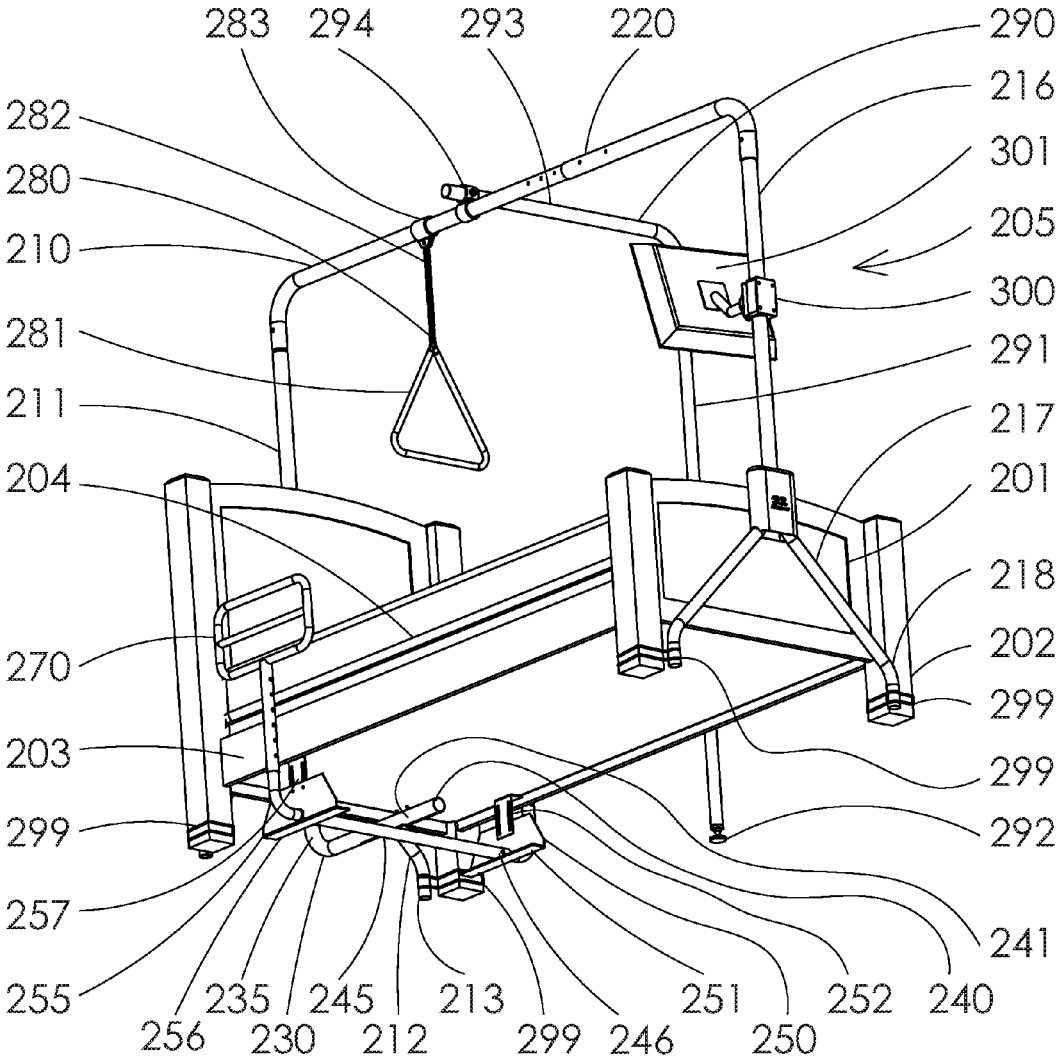
FIG. 9 is an underneath perspective view of the preferred embodiment shown in FIG. 8.
Figure 10:
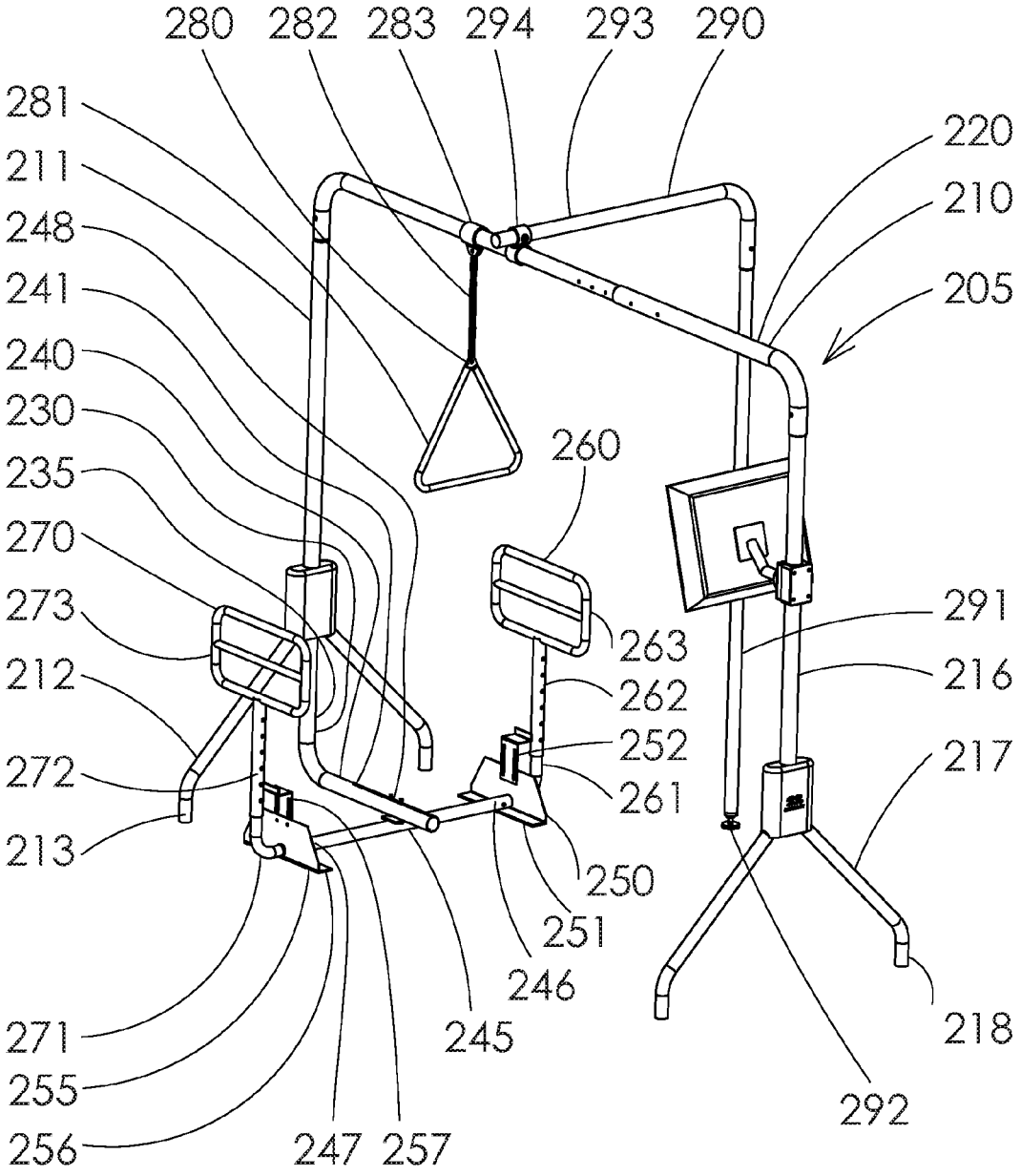
FIG. 10 is a perspective view of an alternative embodiment of the present invention shown without a bed.

Turning now to FIGS. 8-10, it is seen that an additional preferred embodiment of the present invention is illustrated. The system 205 can be used with a bed 201 having legs 202, rails 203 around the perimeter and mattresses 204 (mattress is defined to incorporate either the mattress or box spring). The system 205 has many components that can be characterized as structural or functional, or both. The rails can be made of wood, steel, high strength plastic or any other suitably strong material without departing form the broad aspects of the present invention. In addition to the illustrated bed, the present invention is useful with alternate bed styles such as a Hollywood frame and typical hospital beds.

The structural components can include frame bar 210 and an underbed support 230. Some of the functional components can include side rails 260 and 270, overhead grip 280, a balance pole 290 and monitor 301. Other components which are not specifically illustrated, such as overbed table, hand straps or other components, may also be incorporated without departing from the broad aspects of the present invention.

Frame bar 210 is preferably made of a strong and rigid material, such as steel or another metal. Yet, it may also be made of other materials, such as high-strength plastic, without departing from the broad aspects of the present invention. Frame bar 210 is preferably tubular in shape. However, other shapes may be utilized without departing from the broad aspects of the present invention. A first riser 211 is provided. A head base 212 with two laterally extending feet 213 are provided for supporting the first riser 211. A second riser 216 is supported by a foot base 217, also with two laterally extending feet 218. A longitudinal member 220 spans between the risers 211 and 216. The longitudinal member 220 is preferably adjustable in length to accommodate beds of differing lengths, but could also be fixed in length without departing from the broad aspects of the present invention.

The feet 213 and 218 of bases 212 and 217, respectively, are generally spaced to be proximal or adjacent the legs 202 of a standard twin sized bed or the legs and/or wheels of a typical hospital bed. In this regard, a strap 299, as seen in FIG. 9, can be used to secure the feet 213 and 218 to the legs 202 to fix the system 205 to the bed 201. The box spring lock stabilizes the free standing framework to the bed frame. This lock operates at a common element of most twin bed manufacturers. Accordingly, the bed weight further stabilizes the assist rails, described below.

An underbed support 230 is also provided. The underbed support 230 has a vertical member 235 that is preferably connected to the head base 212. A longitudinal member 240 is also provided and loops or extends under the bed 201 along a longitudinal direction. It is preferred that the longitudinal member 240 is centrally located under the bed 201. A longitudinal slot 241 is provided vertically through the longitudinal member 240.

A cross member 245 is further provided. The cross member 245 has ends 246 and 247 that are spaced to accommodate a twin sized bed. However, it is understood that the spacing could be altered without departing from the broad aspects of the present invention. The cross member 245 is preferably generally perpendicular to the longitudinal member 240, and is adjustable there to within the slot 241. Bolts 248, or another suitable locking device, are provided for locking the cross member 245 in the desired place along the longitudinal length of the slot 241 through the longitudinal member 240.

A rail lock 250 is on the first end 246 of the cross member 245. The rail lock 250 has a base 251 and a flange 252. The flange is adjustable in the vertical direction relative the base 251. The flange 252 is positionable between the bed rails 203 and the box spring or mattress 204. In this regard, the flange 252 locks the system 205 relative the bed 201.

A second rail lock 255 is further provided and is located on the second end 247 of the cross member 245. The rail lock 255 has a base 256 and a flange 257. The flange 257 is adjustable in the vertical direction relative the base 251. The flange 257 is positionable between the bed rails 203 and the box spring or mattress 204. In this regard, the flange 257 locks the system 205 relative the bed 201.

As can be appreciated, supports are provided for mounting components both above and below the bed, providing for a limitless amount of customization to enhance mobility, comfort and maneuverability of the person.

Turning now to some of the accessories, it is seen that an assist rail 260 is provided. Assist rail 260 has a base 261 that can be integrated into the end 246 of the cross member 245. The assist rail 260 further has an adjustable upright 262 and a rail 263. The longitudinal position of the rail 263 is determined by the location of the cross member 245 relative the longitudinal member 240. The assist rail 260 may be fabricated from steel, another metal, plastic or other suitable material. It is possible that the assist rail may swivel without departing from the broad aspects of the present invention.

A second assist rail 270 can also be provided. Assist rail 270 has a base 271 that can be integrated into the end 247 of the cross member 245. The assist rail 270 further has an adjustable upright 272 and a rail 273. The longitudinal position of the rail 273 is determined by the location of the cross member 245 relative the longitudinal member 240. The assist rail 270 may be fabricated from steel, another metal, plastic or other suitable material. It is possible that the assist rail may swivel without departing from the broad aspects of the present invention.

An overhead grip 280 can be provided as an overbed component. One preferred grip 280 is a triangle 281. Another example could be a hand strap. A hanger 282, which is flexible and adjustable, is provided, as is a cuff 283. The cuff 283 is adjustable along the longitudinal length of the longitudinal member 220. The triangle 281 may be made of steel, another metal, plastic or any other suitable material.

A balance pole 290 has a vertical bar 291 with a base 292. The base is adjustable along an axis that is generally parallel to the vertical axis of the vertical bar 291. A horizontal bar 293 is also provided. A double cuff 294 is provided having two cuffs that are preferably fixed in perpendicular orientations. One cuff may adjustably receive the horizontal bar 293 of the pole 290. The second cuff adjustably moves relative longitudinal bar 220 of frame bar 210.

A monitor 301, television or other device may be supported by a mount 300 connected to riser 216.

It is appreciated that many other components, such as IV hangers, mirrors, picture frames and other components may be supported by the system 205. In this regard, the components described above are not intended to be limiting of the present inventions.

It is still further appreciated that special head and foot boards may be developed to receive the frame bars. In such an embodiment, the new head board and foot board would accept the structural components of the present invention.

While the present embodiment of the invention is illustrated in connection with a twin bed, it is appreciated that the present invention can also be designed for use over other size beds. Further, for hospital bed use, it is appreciated that the underbed support 230 can be removed and the system 205 can nevertheless be fixed to the bed 201 by relying on straps 299 alone.

Thus it is apparent that there has been provided, in accordance with the invention, a mobility and comfort auxiliary bed apparatus that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A system for use with a bed, said system comprising:

a first frame bar having a first frame bar longitudinal rail;

a second frame bar having a second frame bar longitudinal rail;

a first double cuff, said first double cuff having a first double cuff first cuff and a first double cuff second cuff that is fixed in a perpendicular orientation relative to said first double cuff first cuff, wherein said first frame bar longitudinal rail passes through said first double cuff and said first double cuff is movable relative to said first frame bar longitudinal rail;

a second double cuff, said second double cuff having a second double cuff first cuff and a second double cuff second cuff that is fixed in a perpendicular orientation relative to said second double cuff first cuff, wherein said second frame bar longitudinal rail passes through said second double cuff and said second double cuff is movable relative to said second frame bar longitudinal rail; and a balance pole, said balance pole comprising:

a vertical portion having a base;

a horizontal portion being laterally and longitudinally adjustable and securing said balance pole to both of said first frame bar longitudinal rail with said first double cuff and said second frame bar longitudinal rail with said second double cuff, said horizontal portion passing through said first double cuff and said second double cuff, wherein said balance pole is supported at said base and at two positions along said horizontal portion.

2. The system of claim 1 further comprising a trapeze bar directly supported by both said first frame bar longitudinal rail and said second frame bar longitudinal rail.

3. A system for use with a bed having legs, said system comprising:

a frame bar supported directly on a floor;

a base, said base comprising a first seat and a second seat receiving the legs of the bed to structurally connect said system and the bed, said base comprising:

a plurality of key holes laterally disposed within said base;

a first laterally adjustable brace, said first seat being a part of said first laterally adjustable brace; and a second laterally adjustable brace, said second seat being a part of said second laterally adjustable brace, wherein:

said first laterally adjustable brace comprises:

a first laterally adjustable brace peg; and a first laterally adjustable brace rod; and said second laterally adjustable brace comprises:

a second laterally adjustable brace peg; and a second laterally adjustable brace rod, said first laterally adjustable brace peg and said first laterally adjustable brace rod are receivable within two of said plurality of key holes;

said second laterally adjustable brace peg and said second laterally adjustable brace rod are receivable within two of said plurality of key holes; and the width between said first seat and said second seat is dependent upon which of said plurality of key holes said first laterally adjustable brace and said second laterally adjustable brace are connected to;

said frame bar supports at least one overbed component; and said system is removably fixable in position relative to the bed.

4. The system of claim 3 further comprising a centrally located longitudinal support having at least one member, wherein underbed components are supportable by at least one of:

said central support;

said first laterally adjustable brace rod, or said second laterally adjustable brace rod.

5. The system of claim 4 wherein:

said base has a middle; and said central support comprises a first longitudinal support and a second longitudinal support, said first longitudinal support and said second longitudinal support being received within any of said plurality of key holes generally in said middle of said base.

* * * * *